US006709194B1

(12) United States Patent
Grimes

(10) Patent No.: US 6,709,194 B1
(45) Date of Patent: Mar. 23, 2004

(54) APPARATUS FOR SCREEDING CONCRETE AND OTHER MATERIALS

(76) Inventor: Jim Grimes, 980 Stenton Way, Galt, CA (US) 95632

( * ) Notice: Subject to any disclaimer, the term of this patent is extended or adjusted under 35 U.S.C. 154(b) by 0 days.

(21) Appl. No.: 10/406,735

(22) Filed: Apr. 2, 2003

(51) Int. Cl.[7] ..... E01C 19/22

(52) U.S. Cl. ..... 404/96; 404/118; 248/125.1; 248/132

(58) Field of Search ..... 404/118, 119, 404/96; 248/125.1, 132, 176.1, 176.3

(56) References Cited

U.S. PATENT DOCUMENTS 413,846 A * 10/1889 Chambers ..... 404/119
1,037,194 A * 9/1912 Berger ..... 172/684.5
2,032,736 A * 3/1936 Briggs ..... 405/268
2,306,450 A * 12/1942 Lewis ..... 249/4
3,543,653 A * 12/1970 Meadows et al. ..... 404/83
4,412,803 A * 11/1983 Allen ..... 425/456
5,257,764 A * 11/1993 Spaulding ..... 248/125.1
6,488,443 B2 * 12/2002 Garrity, Jr. ..... 404/110

* cited by examiner

*Primary Examiner*—Gary S. Hartmann
(74) *Attorney, Agent, or Firm*—Thomas R. Lampe

(57) ABSTRACT

Apparatus for screeding concrete and other materials includes a primary support and a secondary support adjustably slidably movable on the primary support to raise or lower an elongated screed guide member. The secondary support includes a receptacle for holding the elongated screed guide member. Surface engaging support structure is provided at the lower end of the apparatus to disperse downwardly directed forces.

5 Claims, 3 Drawing Sheets

APPARATUS FOR SCREEDING CONCRETE AND OTHER MATERIALS

TECHNICAL FIELD

This invention relates to apparatus for screeding concrete and other materials. The apparatus is portable and may be used, for example, to smooth the surfaces of large concrete slabs. This is accomplished without penetrating plastic sheets or other vapor barriers commonly deployed between the ground and slab.

BACKGROUND OF THE INVENTION

The use of screeds for leveling or smoothing concrete and other materials is well known, screeds dating back many decades, if not centuries. Typically, when screeding large slabs, screed stakes and saddles have been employed to mount lumber or other elongated screed guide members to maintain them at a desired height and orientation. This not only is time consuming, but the technique has other disadvantages as well. When stakes are employed, vapor barrier sheets upon which the slabs often are formed are penetrated by the stakes, creating breaches in the vapor or moisture barriers which can have adverse effects.

DISCLOSURE OF INVENTION

The present invention relates to apparatus for screeding concrete and other materials which is readily positionable in place and can quickly be adjusted to position an elongated screed guide associated therewith at the desired height and orientation. Furthermore, the apparatus will not pierce plastic sheets or other types of vapor barriers and degrade their performance.

The apparatus includes a primary support positionable on a surface to extend upwardly therefrom.

A secondary support is adjustably mounted on the primary support for selective up or down movement relative thereto, the secondary support for supporting an elongated screed guide member.

The apparatus also includes adjustment mechanism operatively associated with the primary support and the secondary support to adjust the position of the secondary support on the primary support to selectively move the secondary support and any elongated screed guide member supported thereby toward or away from the surface.

Other features, advantages and objects of the present invention will become apparent with reference to the following description and accompanying drawings.

BEST MODE FOR CARRYING OUT THE INVENTION

Figures 4, 5, 6:
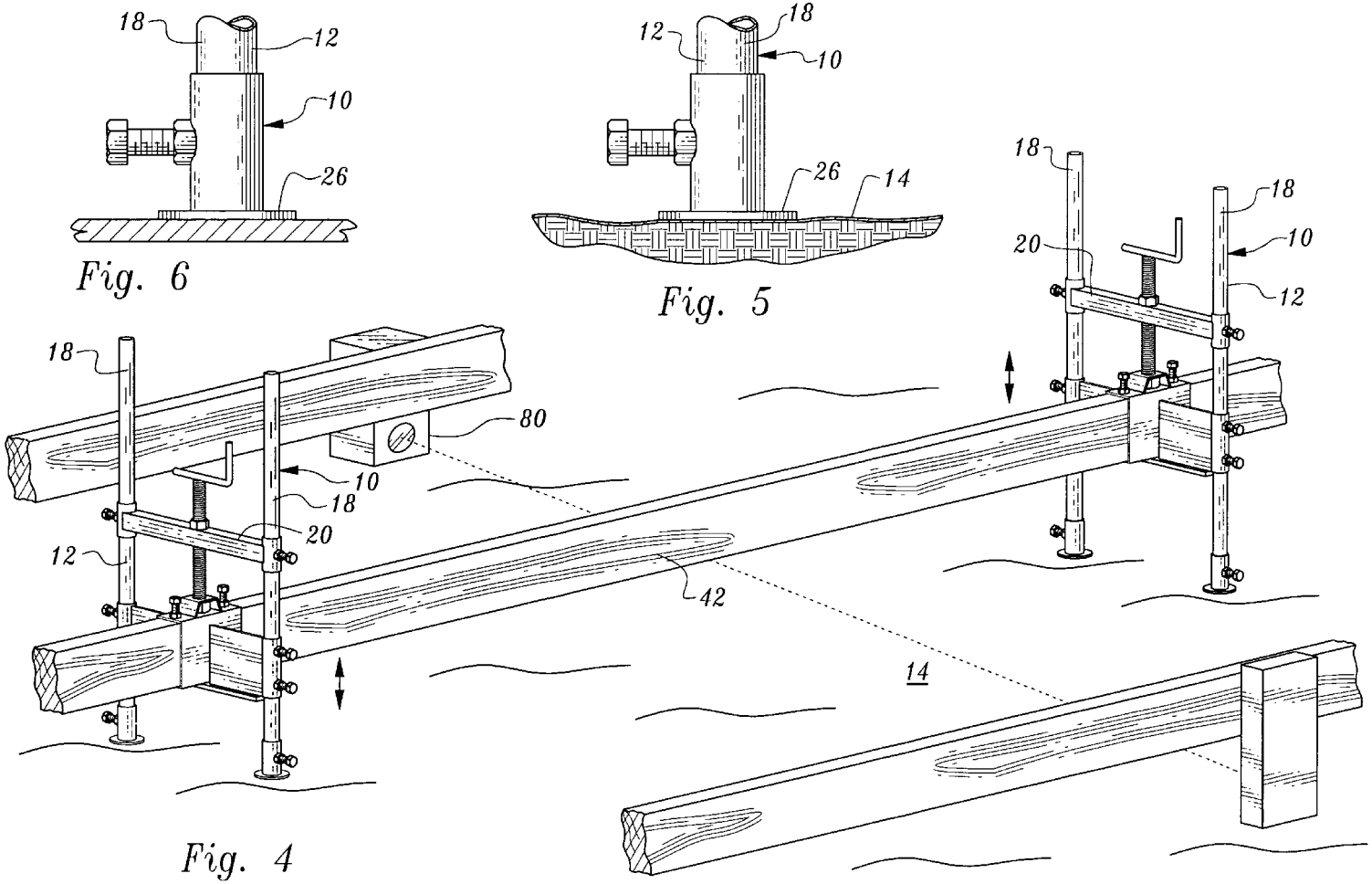
FIG. 4 is a perspective view illustrating an elongated wooden screed guide member being supported at two locations by two devices apparatus constructed in accordance with the teachings of the present invention.
FIG. 5 is a greatly enlarged, detail, elevational view illustrating a surface engaging support pad of the apparatus positioned on a vapor barrier sheet disposed on the ground.
FIG. 6 is a view similar to FIG. 5, but illustrating the surface engaging support pad positioned directly upon metal decking employed to support a slab of concrete.
Figure 7:
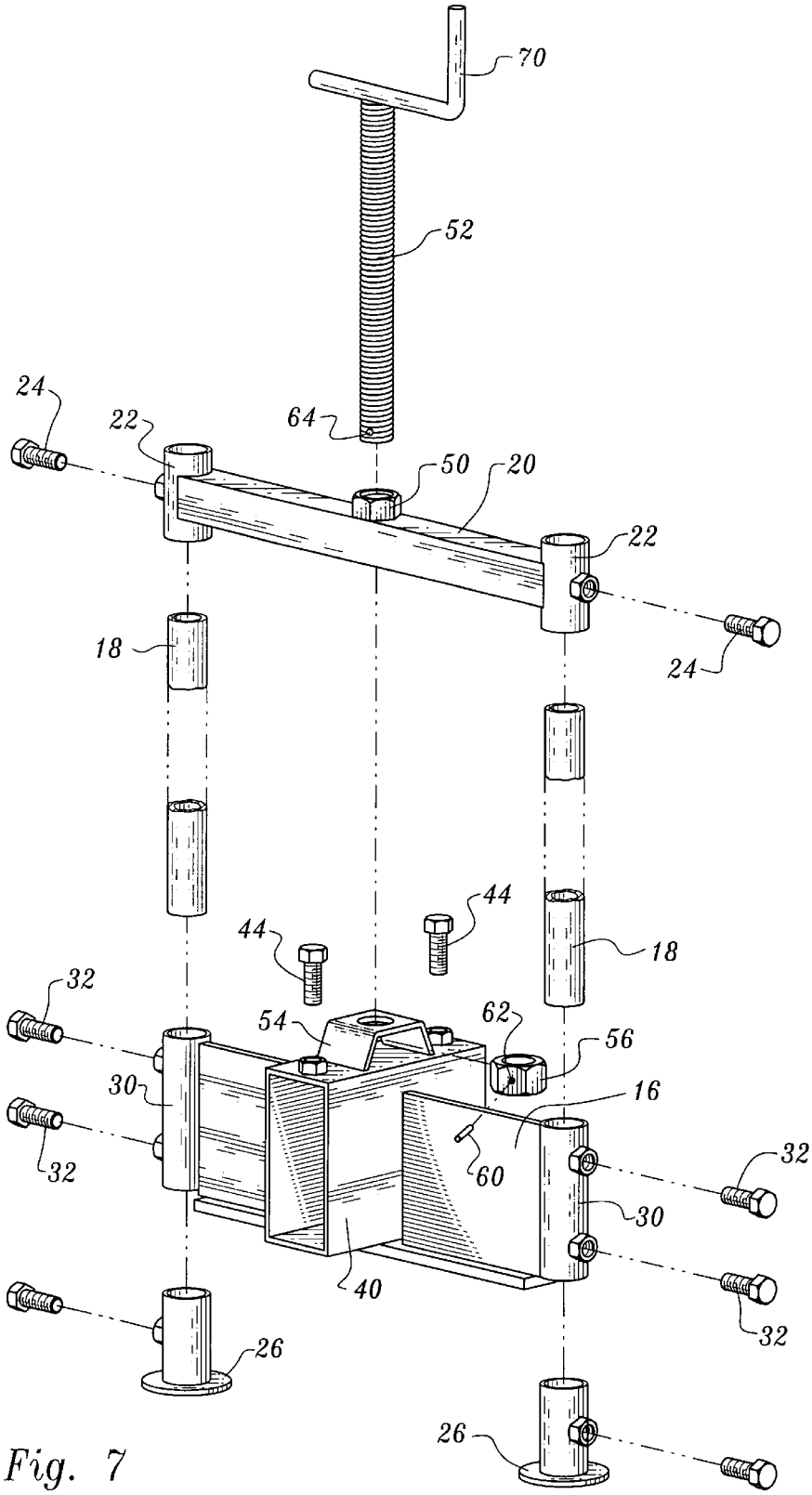
FIG. 7 is an exploded, perspective view of components of the apparatus.

Referring now to the drawings, a preferred form of apparatus 10 constructed in accordance with the teachings of the present invention is illustrated. Apparatus 10 includes a primary support 12 positionable on a surface to extend upwardly therefrom. In FIG. 4 two units of apparatus 10 are illustrated positioned on a vapor barrier sheet 14 disposed on the ground. FIG. 5 shows a portion of the lower end of the primary support 12 of one of the devices positioned on the vapor barrier sheet 14.

Figures 1, 2, 3:
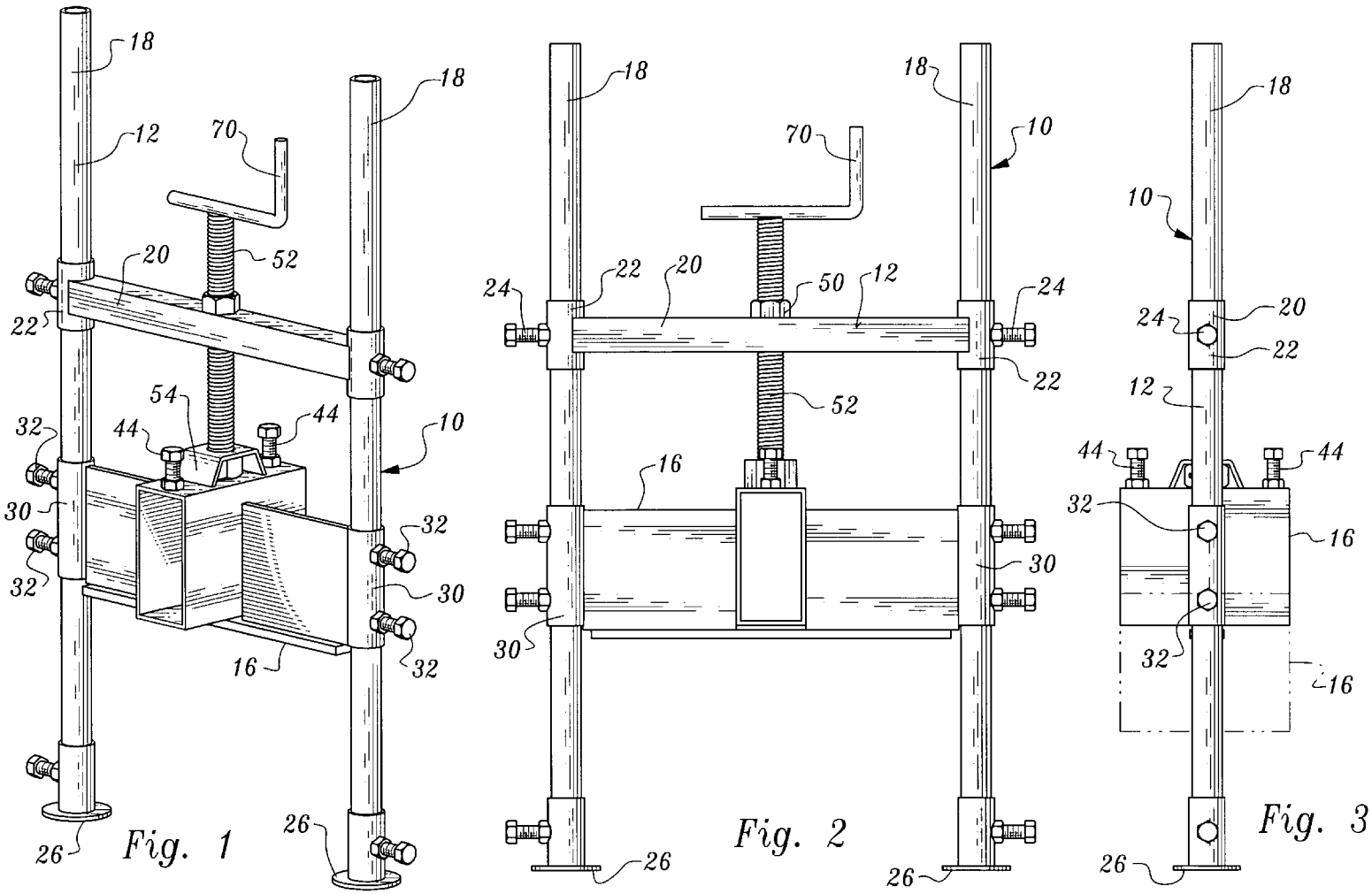
FIG. 1 is a perspective, elevational view of apparatus constructed in accordance with the teachings of the present invention.
FIG. 2 is a front, elevational view of the apparatus.
FIG. 3 is a side, elevational view of the apparatus, showing alternative positions assumed by a secondary support employed in the apparatus by means of solid and dash lines.

The apparatus 10 also includes a secondary support 16 adjustably mounted on the primary support 12 for selective up or down movement relative thereto. FIG. 3 illustrates the secondary support 16 in two representative alternative positions shown in solid and dash lines.

The primary support 12 comprises a framework including a pair of spaced, elongated, substantially vertically oriented framework elements 18 which may, for example, be steel tubing. A framework cross-piece 20 extends between the framework elements 18 and includes sleeves 22 slidably receiving the framework elements 18. Cross-piece locks in the form of lock screws 24 are threadedly engaged with the sleeves 22 and are employed to selectively lock the framework cross-piece 20 against movement relative to the framework elements 18.

Disposed at the bottom ends of the elongated, substantially vertically oriented framework elements 18 are surface engaging support pads 26. These support pads 26 have smooth bottoms and are utilized to support the apparatus and disperse downwardly directed forces exerted by the framework elements 18 on the surface on which the apparatus is positioned.

When this surface is a plastic sheet or other type of liquid vapor sheet, the dispersion of forces greatly reduces the possibility of punctures in the vapor barrier sheet occurring through use and placement of the apparatus. In the arrangement illustrated, the support pads 26 are releasably attached to the framework elements 18 by lock screws.

The secondary support 16 extends between framework elements 18 and is selectively slidably movable along the framework elements. The secondary support 16 includes tubular-shaped guides 30 defining guide openings slidably receiving the framework elements 18. Secondary support locks in the form of lock screws 32 threadedly engaged with the guides 30 are provided to move into or out of locking engagement with the framework elements to either prevent or allow slidable movement between the secondary support and the primary support.

The secondary support 16 includes an open ended receptacle 40 in the form of a channel having a rectangular-shaped cross-sectional configuration. The receptacle 40 is located between the framework elements 18 and is releasably receiving an elongated screeded guide member such as board 42 shown in FIG. 4 Lock screws 44 are threaded engaged with the receptacle 40 and can be moved in or out of the interior of the receptacle to lock the board 42 in fixed position relative to receptacle 40.

A nut is welded or otherwise affixed to the upper surface of framework cross-piece 20 and threadedly receives a threaded shaft 52 which extends through the cross-piece and downwardly therefrom. The lower end of the threaded rod 52 passes through an aperture formed in a bracket 54 welded or otherwise secured to the top of receptacle 40. A nut 56 is positioned in the space between the receptacle and the top portion of the bracket 54 and threadedly engaged with the bottom of the threaded rod 52. The nut 56 is fixed against movement relative to the threaded rod by a lock pin 60 extending into a hole 62 formed in nut 56 and an aligned hole 64 formed in the lower end of the threaded rod 52.

A manually graspable handle 70 is secured to the top of threaded rod 52. Rotation of handle 70 will cause the secondary support 16 and any elongated screed guide member positioned in receptacle 40 to move up or down, that is toward or away from the surface on which the apparatus is positioned. Of course, this movement can only take place when lock screws 32 have been loosened. Once the secondary support 16 and board or other elongated screed guide member have been correctly positioned, the lock screws 32 are tightened. It will be appreciated that this adjustability feature and the adjustability of framework cross-piece 20 relative to framework elements 18 provide for a large range over which an elongated screed guide member supported by the apparatus may be positioned in a highly stable manner. The apparatus 10 may be employed alone or in conjunction with another apparatus of like construction as shown in FIG. 4. A laser system 80 of any suitable known construction may be employed to properly place and orient the board or other elongated screed guide member.

FIG. 6 is a view similar to FIG. 5, but showing the apparatus positioned on a metal deck 90 on which a slab is to be formed.

The invention claimed is:

1. Apparatus for screeding concrete and other materials, said apparatus comprising, in combination:

a primary support positionable on a surface to extend upwardly therefrom, said primary support comprising a framework including a pair of spaced, elongated, substantially vertically oriented framework elements having unthreaded outer surfaces and bottom ends and surface engaging support pads disposed at the bottom ends of said elongated, substantially vertically oriented framework elements to support the apparatus and disperse downwardly directed forces exerted by said elongated, substantially vertically oriented framework elements on said surface, said primary support additionally comprising a cross-piece extending between and connected to said spaced, elongated, substantially vertically oriented framework elements;

a secondary support adjustably mounted on said primary support for selective up or down movement relative thereto, said secondary support for supporting an elongated screed guide member, said secondary support spaced from said cross-piece, extending between the elongated, substantially vertically oriented framework elements and selectively slidably movable along the unthreaded outer surfaces of said elongated, substantially vertically oriented framework elements, said secondary support including guides defining guide openings slidably receiving said elongated, substantially vertically oriented framework elements, said guides being attached to one another and engaging and simultaneously freely slidably movable along the unthreaded outer surfaces of said elongated, substantially vertically oriented framework elements, said secondary support further including a receptacle located between said elongated, substantially vertically oriented framework elements for releasably receiving the elongated screed guide member; and adjustment mechanism operatively associated with said secondary support said primary support to selectively move said secondary support and any elongated screed guide member supported thereby toward or away from the surface, said adjustment mechanism including a threaded shaft extending between said primary support and said secondary support, said threaded shaft being located between said guides and spaced from the surface and threadedly engaged to at least one of said primary support and said secondary support, rotation of said threaded shaft relative to said primary support and said secondary support moving said secondary support selectively up or down relative to said primary support and relative to said surface, said adjustment mechanism additionally comprising a manually actuatable handle connected to said threaded shaft, rotation of said handle and said threaded shaft causing simultaneous slidable movement of said guides along the unthreaded outer surfaces of said elongated, substantially vertically oriented framework elements.

2. The apparatus according to claim 1 wherein said threaded shaft is threadely engaged with said cross-piece.

3. The apparatus according to claim 1 wherein said apparatus additionally comprises locks selectly locking said cross-piece against movement relative to said elongated, substantially vertically oriented framework elements.

4. The apparatus according to claim 1 additionally comprising secondary support locks selectively locking said secondary support against movement relative to said primary support.

5. The apparatus according to claim 4 wherein said secondary support locks comprise threaded lock members threadedly engaged with said guides for selective movement into or out of locking engagement with said elongated, substantially vertically oriented framework elements.

* * * * *